US005302204A

United States Patent [19]

Hayslip

[11] Patent Number: 5,302,204

[45] Date of Patent: * Apr. 12, 1994

[54] METHOD AND APPARATUS FOR PRODUCING AN IMITATION STONE FINISH

[75] Inventor: Michael R. Hayslip, Dallas, Tex.

[73] Assignee: Clark Moulding, Co., Inc., Dallas, Tex.

[ * ] Notice: The portion of the term of this patent subsequent to May 19, 2009 has been disclaimed.

[21] Appl. No.: 885,134

[22] Filed: May 18, 1992

Related U.S. Application Data

[63] Continuation of Ser. No. 569,593, Aug. 20, 1990, Pat. No. 5,113,786, which is a continuation of Ser. No. 276,871, Nov. 28, 1988.

[51] Int. Cl.[5] ..... B05B 7/12; B05C 5/00

[52] U.S. Cl. ..... 118/300; 427/424; 239/405; 239/417.3

[58] Field of Search ..... 239/405, 417.3; 118/300, 314, 315; 427/424

[56] References Cited

U.S. PATENT DOCUMENTS 5,113,786 5/1992 Hayslip ..... 118/314

*Primary Examiner*—Marianne Padgett

*Attorney, Agent, or Firm*—Timmons & Kelly

[57] ABSTRACT

A method and apparatus for placing an imitation stone finish on a workpiece. The method includes first spraying the workpiece with an intermediate coating of pigmented, catalyzed material. Then, the workpiece is sprayed with a mottling coating, which is a pigmented mixture of solvents. The apparatus has two pair of spray guns. The first pair of spray guns spray a quantity of pigmented, catalized urethane material onto the workpiece. The second pair of spray guns spray a quantity of a pigmented mixture of solvents onto the workpiece.

9 Claims, 2 Drawing Sheets

METHOD AND APPARATUS FOR PRODUCING AN IMITATION STONE FINISH

This is a continuation of application Ser. No. 07/569,593, filed Aug. 20, 1990, now patented as U.S. Pat. No. 5,113,786, which was a continuation of application Ser. No. 07/276,871, filed Nov. 28, 1988, now abandoned.

BACKGROUND OF THE INVENTION

1. Field of the Invention

This invention relates in general to a method and apparatus for placing a finish on a material, such as metal, plastic, or wood. In particular, the method and apparatus are for placing on the material a finish that imitates a stone, such as marble.

2. Description of the Prior Art

It has long been a common practice to put a finish on an object in order to make the object appear to be made of a different material. For example, metal, plastic, or wood can be made to appear to be marble, granite, onyx, or other material. Thus, the aesthetic beauty of stone can be added to a different material having other desirable characteristics, such as high strength, low weight, or low cost.

U.S. Pat. No 242,728 issued Jun. 7, 1881, to Withers, disclosed a method for giving a marble or granite appearance to several materials, including slate, stone, iron, wood, cloth, paper, papier-mache, leather, glass, porcelain, china, and crockery. The Withers method included first priming the material with paint. Then, a coating of color ground in water mixed with fermented liquor was applied. Next, while the coating was still wet, the coating was sprinkled with a hot solution of alkali. Finally, a varnish was applied as a finish or protective coat.

An automatic marbleizing apparatus was disclosed in U.S. Pat. No. 3,340,087, issued Sep. 5, 1967, to Mazzola. This apparatus creates a marble appearance by spraying a diluted material, such as lacquer, through a layer of disoriented material, such as steel wool. The substrate material could be practically any material, such as stone, brick, metal, plastic, glass, wood, masonite, china, fabric, canvas, or leather. In order to protect the simulated marble effect, the treated material is sprayed with a coating of clear lacquer.

Although many methods of producing imitation stone finishes have been devised, most have been for low production or one-of-a-kind arts and crafts replication, primarily on organic substrates. None meets all of the desired criteria for replicating an imitation stone finish.

It is desired that an imitation stone finish meet five criteria. First the method of applying the finish should be suitable for three dimensional, pre-coated metal. The finish should be sufficiently durable to withstand packaging, handling, and normal fabrication methods. The finish should also be colorfast and consistently reproducible. Finally, the application method should be appropriate for high volume, automated production, where all of the steps are completed in one pass. None of the prior art methods meets all five of these criteria.

SUMMARY OF THE INVENTION

The object of the invention is to apply a marketable imitation stone finish onto a material surface. The method and apparatus of the invention meet the desired criteria. The method is suitable for three-dimensional pre-coated metal and is sufficiently durable to withstand packaging, handling, and normal fabrication methods. The finish is colorfast consistently reproducible, and appropriate for high volume, automated production.

The method of the invention first provides a substrate material with a clean, smooth, non-porous surface. An intermediate coat is then sprayed onto the substrate. The intermediate coat is a pigmented, catalyzed urethane material.

Before the intermediate coat dries, a mottling coat is sprayed over the intermediate coat. The mottling coat is a pigmented mixture of solvents, including co-solvents and dilutents. The mottling coat is formulated to disrupt normal flow of the intermediate coat. The solvents in the mottling coat flash off before the intermediate coat sets, depositing patterns of color in its wake.

DESCRIPTION OF THE PREFERRED EMBODIMENT

Figure 1:
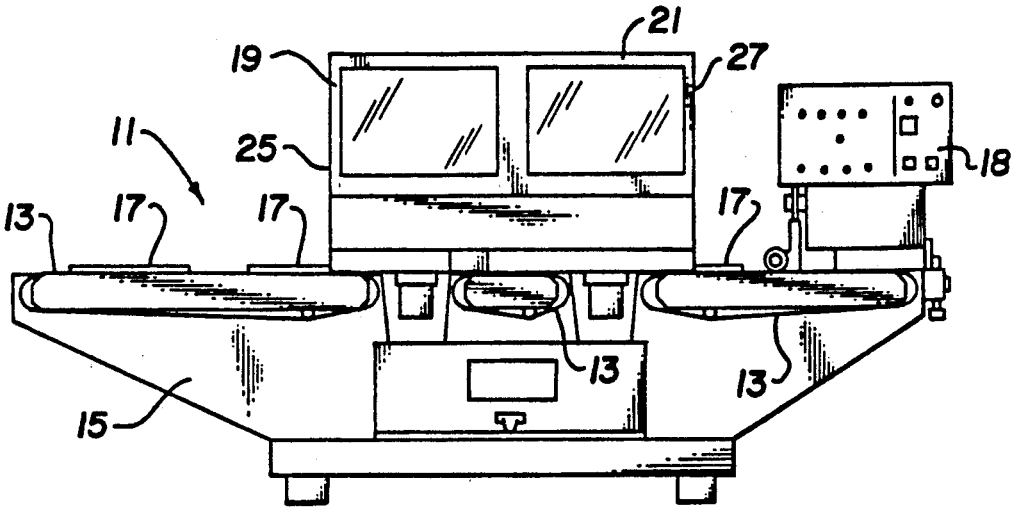
FIG. 1 is a front view of the apparatus used in performing the method of the invention.
Figure 2:
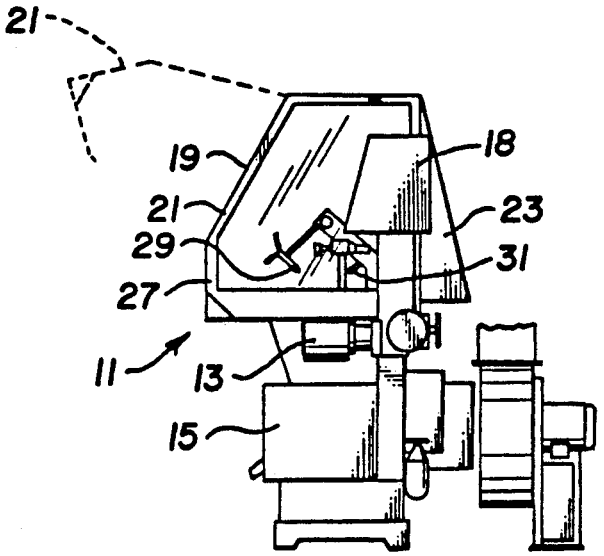
FIG. 2 is a side view of the apparatus shown in FIG. 1.
Figure 3:
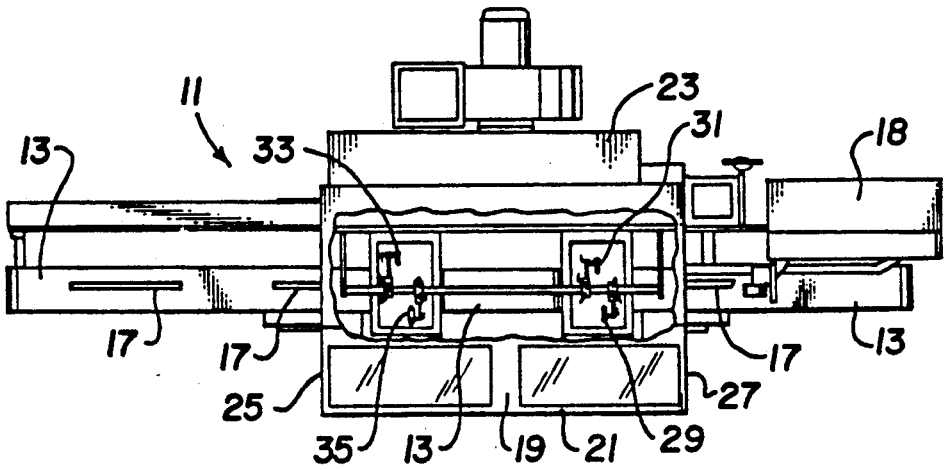
FIG. 3 is a top view of the apparatus shown in FIG. 1.

The method of the invention is preferably performed using an apparatus 11 illustrated in FIGS. 1-3. The apparatus 11 is a modification of a CSP4 automatic staining and varnishing machine produced by Macor.

The apparatus 11 has conveyor means that comprises three conveyors 13 of the endless belt type, mounted on a base 15. The conveyors 13 rotate and move a workpiece 17 through the apparatus 11, from right to left as shown in FIG. 1. The apparatus 11 is programmed and controlled by means of a controller 18 located near the input end of the conveyors 13.

The workpiece 17 may be made of any material having a clean, smooth, non-porous surface to which an intermediate coat will effect chemical and mechanical bonding without dissolving. For example, the workpiece 17 may be a length of extruded aluminum picture frame moulding with a standard baked enamel finish. The moulding may have a variety of colors and glosses.

The central portion of the conveyor means 13 is covered by a cabin 19. The cabin 19 has a front 21, a back 23, and two sides 25 and 27. The front 21 and sides 25 and 27 have transparent windows, so that work in progress can be seen. The front 21 of the cabin 19 can be pivoted upward to provide access to the central portion of the conveyor.

As the workpiece 17 enters the cabin 19, the workpiece 17 first passes under a pair of intermediate spray guns 29 and 31. These spray guns 29 and 31 are mounted at an angle of approximately ninety degrees relative to one another and each spray gun 29 and 31 is mounted at an angle of approximately forty-five degrees relative to horizontal. The spray guns 29 and 31 are located approximately twelve to fifteen inches away from the surface of the workpiece 17.

The intermediate spray guns 29 and 31 are preferably Graco 218-152 spray guns, equipped with DeVilbiss #704 aircaps. Each spray gun 29 and 31 is supplied individually from a common Graco 210-394 pressure pot equipped with a Graco 220-357 agitator. The agitator maintains constant suspension of pigments. The pot pressure is approximately five pounds per square inch and the atomizing pressure may be varied from fifteen to twenty-five pounds per square inch.

As the workpiece 17 passes under the intermediate spray guns 29 and 31, the workpiece is sprayed with an intermediate coat that is pigmented, catalyzed urethane material. This material is, in a preferred form, similar to a polyurethane coating sold by The Sherwin-Williams Company under the trademark Prolane B, reduced to a viscosity of sixteen to eighteen seconds on a #2 Zahn cup. The preferred intermediate coat includes six parts tinted Prolane B polyurethane coating, one part catalyst, such as the catalyst sold by The Sherwin-Williams Company under the trademark Prolane (product number V66 V 27), between one and three parts methyl ethyl ketone, and one part reducer, such as the reducer sold by The Sherwin-Williams Company under the trademark Prolane (product number R7 K 69). Optional additions of thirty millimeters cyclohexane per gallon of fluid mixture may be added to adjust the drying time, depending upon atmospheric conditions. Gloss adjustments may be made with a substance such as the flattening paste sold by The Sherwin-Williams Company under the trademark Prolane (product number F63T1).

Before the intermediate coating has time to dry, the conveyor 13 moves the workpiece 17 under a second pair of spray guns 33 and 35. The second pair of spray guns 33 and 35 are mounted at an angle of approximately ninety degrees relative to one another and each spray gun 33 and 35 is mounted at an angle of approximately forty-five degrees relative to horizontal. The spray guns 33 and 35 are located approximately twelve to fifteen inches away from the surface of the workpiece 17.

These spray guns 33 and 35 are Binks Model 21 automatic spray guns, and have a modified 797 nozzle setup. The modified setup is illustrated in FIG. 6, and is a combination of two prior art setups, illustrated in FIGS. 4 and 5

Figure 4:
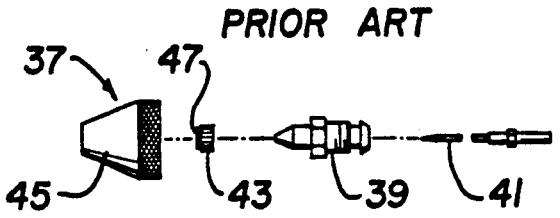
FIG. 4 is an exploded view of a prior art nozzle for a spray gun.

The prior art nozzle 37 shown in FIG. 4 is a distressing nozzle 37. The nozzle 37 has a fluid nozzle 39 and a needle assembly 41. A core. 43 encircles the fluid, nozzle 39 and an air nozzle 45 covers the end of the fluid nozzle 39. The core 43 has a plurality of grooves 47 around the outer surface of the core 43. The grooves 47 extend parallel to the flow of the fluid through the fluid nozzle 39. As paint flows through the fluid nozzle 39, air flows through the grooves 47 in the core 43. The paint and the air are then forced through the air nozzle 45.

Figure 5:
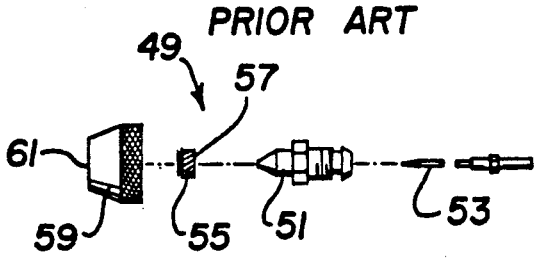
FIG. 5 is an exploded view of a second prior art nozzle for a spray gun.

The nozzle 49 illustrated in FIG. 5 is a veiling nozzle 49. The veiling nozzle 49 has a fluid nozzle 51 and a needle assembly 53 that are identical to the fluid nozzle 39 and the needle assembly 41 of the distressing nozzle 37. However, the veiling nozzle 49 has a core 55 that has spiral grooves 57. Also, the air nozzle 59 has a larger opening 61 than the air nozzle 45 on the distressing nozzle 37. As a result, the air is forced to spiral around the paint as the air and the paint are forced through the nozzle 49.

Figure 6:
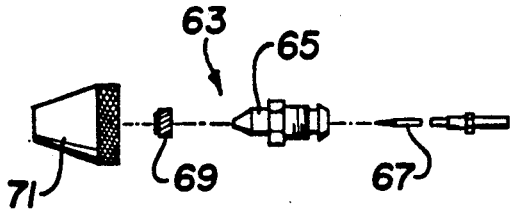
FIG. 6 is an exploded view of the nozzle for the spray gun of the invention.

The modified nozzle 63 of the invention, shown in FIG. 6, also has a fluid nozzle 65 and a needle assembly 67 that are identical to the fluid nozzle 39 and the needle assembly 41 of the distressing nozzle 37. However, the modified nozzle 63 invention, has a spiral core 69 like the spiral core 55 of the veiling nozzle 49 and an air nozzle 71 like the air nozzle 45 of the distressing nozzle 37. Air passing through the modified nozzle 63 spirals and creates turbulence within the air nozzle 71. The modified nozzle 63 thus sprays in a series of erratic droplets, rather than in a conventional evenly spaced atomized pattern.

The second pair of spray guns 33 and 35 are supplied by a DeVilbiss LUX577 portable transfer pump with an agitator. Consistent pigment suspension is assured by recirculating the fluid supply. Recirculation is essential, since no film formers are present in the material sprayed. Pressure at the transfer pump ranges from twenty to forty pounds per square inch. Fluid pressure is individually regulated at each gun 33 and 35. Atomizing pressure may vary from ten to forty pounds per square inch, depending on the desired pattern.

As the workpiece 17 passes under the second pair of spray guns 33 and 35, the workpiece 17 is sprayed with a mottling coat. This mottling coat is a pigmented mixture of solvents, including co-solvents and diluents. The mottling coat is formulated to disrupt normal flow of the intermediate coat and to flash off as the intermediate coat moves under the influence of other components in the mottling coat. This disruptive surfactant movement is effected through the presence of straight-chain aliphatic petroleum-distillate hydrocarbons with six to eight carbon atoms and an alcohol with six to eight carbon atoms in combination with a moderate ketone. The urethane film former of the intermediate coat is simultaneously dissolved and dispersed through attraction and repulsion of solvent molecules.

The specific formula of the mottling coat includes twenty percent methyl ethyl ketone, forty percent heptane (a hydrocarbon), and forty percent lactol diluent (an hydroxyl or an alchohol). Depending upon the desired color intensity, one to two ounces per gallon of Sherwin-Williams acrylic tint may be added. Also, ten to thirty milliliters per gallon of cyclohexanone may be added to adjust for atmospheric conditions.

The exact speed of the conveyor 13 will vary according to the desired color intensity, the pattern desired, material viscosity, paint drying properties, atmospheric conditions, fluid pressure, and the size of the spraying tips. The preferred speed is between seventy-five and one hundred twenty-five feet per minute.

The method of the invention has several advantages over the prior art. The finish dries to touch within minutes and requires no further coating or treatment. The finish is consistently reproducible and is suitable for pre-coated metal, such as extruded aluminum.

The invention has been shown in only one of its forms. It should be apparent to those skilled in the art that it is not so limited, but is susceptible to various changes and modifications without departing from the spirit thereof.

I claim:

1. A spray gun, comprising:

a fluid nozzle;

a needle assembly within the fluid nozzle;

an air nozzle, mounted on the fluid nozzle, to mix air with fluid flowing through the fluid nozzle, the air nozzle having an opening that is small enough to spray in a series of erratic droplets; and a core, mounted within the air nozzle, having a plurality of spiral grooves on the outer surface to cause air to spiral and to create turbulence within the air nozzle.

2. A spray gun as recited in claim 1, wherein the spray gun is mounted at an angle of approximately forty-five degrees relative to a workpiece toward which the spray gun is directed.

3. A spray gun as recited in claim 2, wherein the spray gun is mounted between twelve and fifteen inches above the workpiece.

4. A spray gun for spraying a quantity of pigmented mixture of solvents onto a workpiece to produce an imitation stone finish, comprising:

a fluid nozzle;

a needle assembly within the fluid nozzle;

an air nozzle, mounted on the fluid nozzle, to mix air with solvents flowing through the fluid nozzle, the air nozzle having an opening that is small enough to spray in a series of erratic droplets; and a core, mounted within the air nozzle, having a plurality of spiral grooves on the outer surface to cause air to spiral and to create turbulence within the air nozzle.

5. A spray gun as recited in claim 4, wherein the spray gun is mounted at an angle of approximately forty-five degrees relative to the workpiece.

6. A spray gun as recited in claim 5, wherein the spray gun is mounted between twelve and fifteen inches above the workpiece.

7. In a spray gun for spraying a quantity of fluid onto a workpiece to produce an imitation stone finish, the combination comprising:

a fluid nozzle;

a needle assembly within the fluid nozzle;

an air nozzle, mounted on the fluid nozzle, to mix air with the fluid flowing through the fluid nozzle, the air nozzle having an opening that is small enough to spray in a series of erratic droplets; and a core, mounted within the air nozzle, having a plurality of spiral grooves on the outer surface to cause air to spiral and to create turbulence within the air nozzle.

8. A spray gun as recited in claim 7, wherein the spray gun is mounted at an angle of approximately forty-five degrees relative to the workpiece.

9. A spray gun as recited in claim 8, wherein the spray gun is mounted between twelve and fifteen inches above the workpiece.

* * * * *